US006370696B1

(12) United States Patent
Kronenberger

(10) Patent No.: US 6,370,696 B1
(45) Date of Patent: Apr. 16, 2002

(54) HEADWEAR PIECE

(75) Inventor: Ronald Kronenberger, Riverwoods, IL (US)

(73) Assignee: American Needle, Buffalo Grove, IL (US)

( * ) Notice: Subject to any disclaimer, the term of this patent is extended or adjusted under 35 U.S.C. 154(b) by 0 days.

(21) Appl. No.: 09/675,969

(22) Filed: Sep. 29, 2000

Related U.S. Application Data

(63) Continuation-in-part of application No. 09/504,600, filed on Feb. 15, 2000, now Pat. No. 6,272,689.

(51) Int. Cl.[7] ..... A42B 1/00
(52) U.S. Cl. ..... 2/175.1; 2/195.1; 40/329
(58) Field of Search ..... 2/175.1, 209.12, 2/195.1; 40/329

(56) References Cited

U.S. PATENT DOCUMENTS 2,855,604 A * 10/1958 Austin ..... 2/175.1
5,070,545 A * 12/1991 Tapia ..... 2/195
5,437,062 A * 8/1995 Douglas ..... 2/195.1
5,481,759 A * 1/1996 Rinaldi ..... 2/195.1
5,613,246 A * 3/1997 Alexander ..... 2/10
5,701,607 A * 12/1997 Kaiser ..... 2/209.13
5,715,534 A * 2/1998 Mobley ..... 2/10
5,903,923 A * 5/1999 Morse et al. ..... 2/195.1

* cited by examiner

*Primary Examiner*—Bibhu Mohanty
(74) *Attorney, Agent, or Firm*—Wood, Phillips, VanSanten, Clark & Mortimer

(57) ABSTRACT

The combination of a crown and first and second visor surfaces. The crown has an internal surface for engaging a wearer's head and an external surface with information thereon relating to a golf course. The first visor surface has information thereon relating to the golf course. The second visor surface has information thereon relating to the golf course that is different than the information on the first visor surface. The first and second visor surfaces are selectively interchangeably mounted to the crown so as to project angularly away from the external surface of the crown.

20 Claims, 4 Drawing Sheets

HEADWEAR PIECE

CROSS-REFERENCE

This application is a continuation-in-part of my application Ser. No. 09/504,600, filed Feb. 15, 2000, entitled "Headwear Piece" now U.S. Pat. No. 6,272,689.

BACKGROUND OF THE INVENTION

1. Field of the Invention

This invention relates to headwear and, more particularly, to headwear with information applied thereto.

2. Background Art

Designers in the headwear industry are constantly seeking out innovative designs and concepts to increase public awareness of, and interest in, their product. One highly competitive area is in baseball-style caps and visors which are offered to myriad different customer bases.

Baseball-style caps and visors are commonly adorned with information related to academic institutions. Typically, this information is provided on the front, external surface of a crown. The information commonly identifies the academic institution and/or an activity and/or department associated with the academic institution. The information has been in the form of color, logos, words, simulations of animate and inanimate objects, etc.

Baseball-style caps are also commonly adorned with the identification of golf courses and sold in pro shops and elsewhere to golfers and golf spectators.

It is also known to place information on a visor or bill projecting angularly away from the crown. U.S. Pat. No. 5,983,400, assigned to the assignee herein, discloses an exemplary structure using this concept.

SUMMARY OF THE INVENTION

In one form, the invention is directed to the combination of a crown and first and second visor surfaces. The crown has an internal surface for engaging a wearer's head and an external surface with information thereon relating to a golf course. The first visor surface has information thereon relating to the golf course. The second visor surface has information thereon relating to the golf course that is different than the information on the first visor surface. The first and second visor surfaces are selectively interchangeably mounted to the crown so as to project angularly away from the external surface of the crown.

The crown may have an inverted cup shape for receiving the head of a wearer.

The information relating to the golf course may include at least one color relating to the golf course.

The information relating to the golf course may be at least one of a) a logo, b) written information, c) a representation of at least one of an animate and inanimate object, d) a depiction of a part of the golf course, and e) a depiction of a hole on the golf course.

The information on at least one of the first and second visor surfaces may include the name of a golf tournament.

The information on at least one of the first and second visor surfaces may be at least one of a location, an address, and an electronic mail address.

The first visor surface may be applied to a support layer that is attached to the crown and projects angularly away from the external surface of the crown.

The first visor surface may be attached to each of the support layer and the crown.

The first visor surface may be attached to the support layer using an adhesive.

The first visor surface may be attached to the support layer by stitching.

In one form, the crown has front and rear and laterally spaced sides. With the first visor surface mounted to the crown, the first visor surface has an inverted U shape with an upwardly facing surface portion and laterally oppositely facing surface portions. The information on the first visor surface is located at least partially on one of the laterally oppositely facing surface portions.

In one form, with the first visor surface mounted to the crown, the first visor surface is part of a visor having a peripheral edge having a contour, and the information on the first visor surface follows the contour of the peripheral edge of the visor.

The first and second visor surfaces may each have at least one sheet layer.

The first visor surface may include a sheet, with the information on the first visor surface applied to the sheet before the first visor surface is applied to the support layer.

The information on the first visor surface may be applied by at least one of a dye/paint and embroidery.

Information relating to the golf course may be placed on the external surface of the crown. The information on at least one of the crown external surface, first visor surface, and second visor surface may include a depiction of a part of a golf course.

The part of the golf course may be a hole on the golf course.

The invention is also directed to a headwear piece having a crown and a visor. The crown has an internal surface for engaging a wearer's head and an external surface with information thereon relating to a golf course. The visor projects angularly away from the external surface of the crown. The visor has a surface with information thereon relating to the golf course that is different than the information on the external surface of the crown.

The information on one of the crown external surface and visor surface may include a depiction of a part of the golf course.

The part of the golf course may be a hole on the golf course.

The information on the other of the crown, external surface and visor surface may be at least one of a) the name of the golf course, b) the identity of a golf tournament, c) the identity of an individual, d) a date, e) a location, f) an address, and g) an electronic mail address.

DETAILED DESCRIPTION OF THE DRAWINGS

Figure 1:
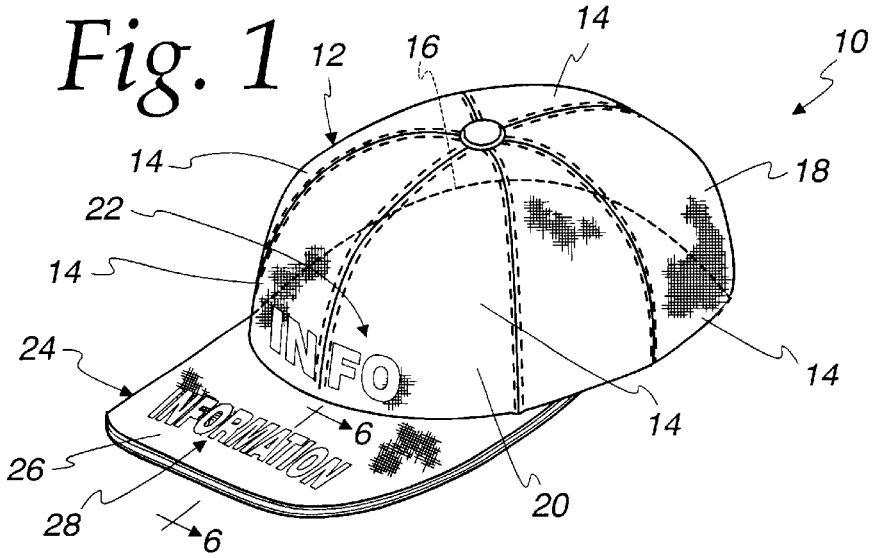
FIG. 1 is a perspective view of one form of headwear piece, according to the present invention, including a cup-shaped crown and visor projecting angularly away from an external surface of the crown with a first type of information on the crown and visor.
Figure 2:
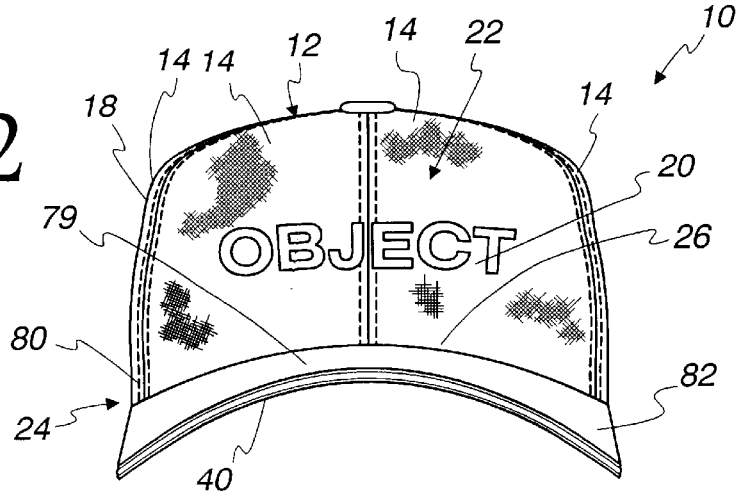
FIG. 2 is a front elevation view of a headwear piece as in FIG. 1 with another form of information on the crown.
Figure 3:
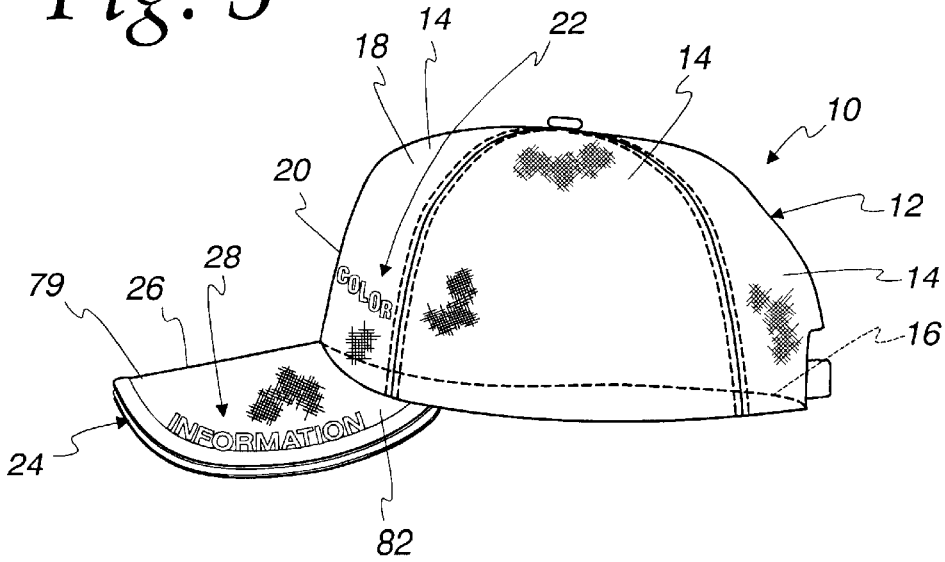
FIG. 3 is a side elevation view of a headwear piece as in FIGS. 1 and 2 with another form of information on the crown and visor.

Referring initially to FIGS. 1–3, one form of headwear piece, according to the present invention, is shown at 10. The headwear piece 10 consists of a crown 12, which in this case is defined by a plurality of triangular gores 14 sewn edge-to-edge to produce an inverted cup shape for receipt of the head of a wearer. The crown 12 defines an internal, annular surface 16 for engaging the head of a wearer and an external surface 18. In this embodiment, the front 20 of the external surface 18 has information 22 thereon relating to a first subject. A visor 24 projects angularly forwardly from the external surface 18 and has a surface 26 with information 28 thereon relating to the first subject.

The information 22 may take a number of different forms. For example, the information 22 may be in the form of a logo, written information, or a representation of at least one of an animate or inanimate object. Alternatively, the information may be in the form of a color or colors associated with the first subject. Other forms of information relating to the first subject are also contemplated.

The nature of the first subject is not limited by the invention. For example, the subject could be a business, athletic team, a sports related entity, such as a golf course, etc. For illustrative purposes only, the invention will be described with reference to an academic institution for the first subject. In this case, the information 22 is of a nature to identify the academic institution. It may consist of the school name, a logo, a picture of the academic institution, or any other type of information which identifies the academic institution.

According to the invention, the information 28 relates to the academic institution and may take a myriad of different forms. For example, the information 28 may relate to a program at the academic institution. For purposes of example only, the program may be one of an athletic team, a non-athletic extracurricular activity, etc. The information may include a date or identify a location, an address, an electronic mail address, etc. As other examples, the information 22 may relate to the status of a wearer. For example, the information 22 may identify an honor student, a faculty member, or an alumnus.

As noted above, the information 22, 28 is not limited to academic institutions. As just one other example, the information 22 may be the identity of a golf course, with the information 28 identifying a location, an electronic mail address, or a signature hole on the course. There are virtually a limitless number of different subject matters contemplated by the invention.

Figure 5:
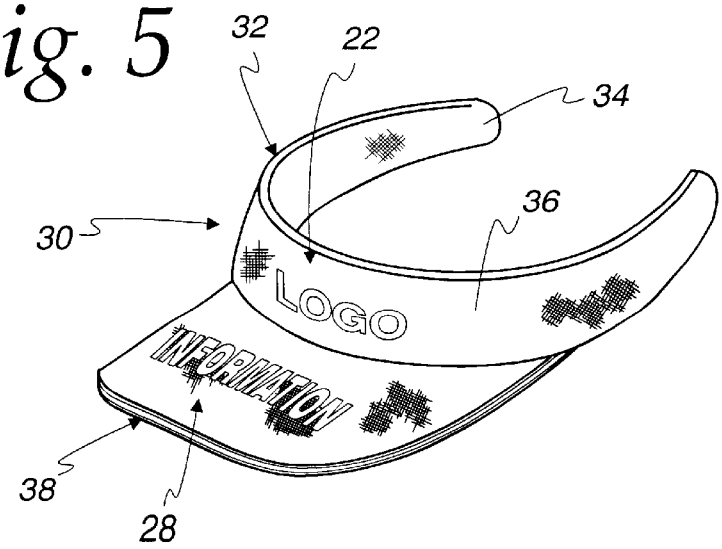
FIG. 5 is a perspective view of a modified form of headwear piece, with information thereon according to the present invention.

It should also be understood that the configuration of the headwear, according to the present invention, is not limited to that shown in FIGS. 1–3. As one other example, in FIG. 5 a visor-type headwear piece is shown at 30. the headwear piece 30 has a crown 32 which extends only partially around a wearer's head and is open at the top. The crown 32 has an internal surface 34 to engage a wearer's head and an exposed external surface 36. A visor 38 projects angularly forwardly away from the external surface 36 of the crown 32. As in the prior embodiments, the headwear piece 30 has information 22 on the external surface 36 of the crown 32 relating to a first subject, and additional information 28 on the visor 38 relating to the first subject.

Figure 4:
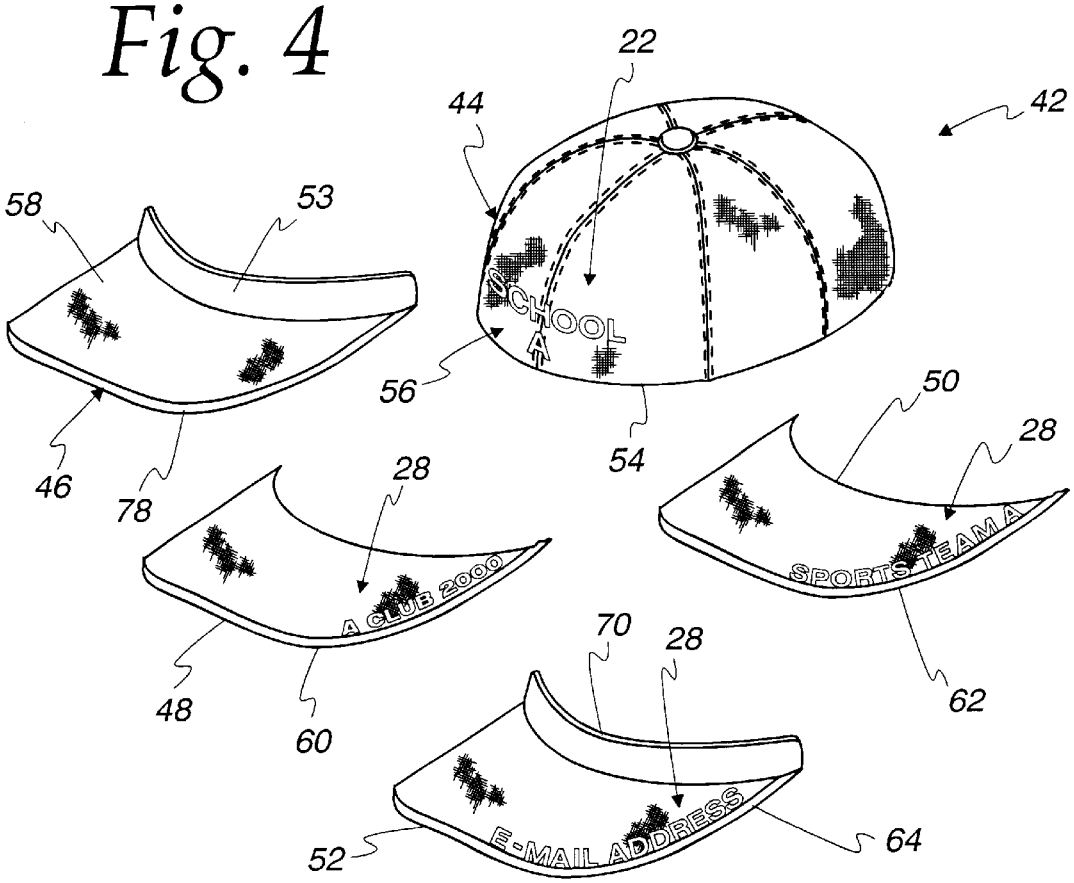
FIG. 4 is a perspective view of a kit for constructing a headwear piece as in FIGS. 1–3 and including a crown with a visor and visor surfaces which can be selectively, interchangeably mounted to the crown and having different forms of information thereon.

Another aspect of the present invention is shown in FIG. 4 and consists of a kit at 42 made up of a crown 44, of the type shown in FIGS. 1–3, a visor support layer 46, and multiple, in this case three, visor surfaces 48, 50, 52, which are selectively interchangeably mountable to the crown 44.

In this embodiment, a headwear line is produceable using a universal crown 44 and visor support layer 46. The visor support layer 46 has an integral flap 53 which can be joined to a lower portion 54 of the crown 44 at the front 56 thereof, as by stitching, or by other means known to those skilled in the art. The visor support layer 46 has an exposed surface 58 to which the visor surfaces 48, 50, 52 can be selectively secured.

In this case, each of the visor surfaces 48, 50, 52 is made from a sheet 60, 62, 64 which can be selectively secured to the surface 58 of the support layer 46. The sheets 60, 62, 64 can take a number of different forms and are preferably a fabric layer or any other flexible layer which can be conformed to the surface 58, be secured positively thereto, and positively sustain the information 28 placed thereon.

In this embodiment, the information 22 on the crown 44 is the identity of an academic institution. The information 28 on the visor surface 48 is the identity of a club and a graduation year for the wearer at the academic institution. The information 28 on the visor surface 50 is the identification of a sports team at the academic institution, while the information 28 on the visor surface 52 is an address associated with the academic institution, in this case an electronic mail address.

By using the common crown 44 and visor layer 46, headwear pieces can be customized for various activities related to the academic institution by interchangeably mounting the surfaces 48, 50, 52, and others of like form, with virtually any type of information relating to the academic institution. This same concept is contemplated for other than academic institutions, i.e. businesses, clubs, events, etc.

Figure 8:
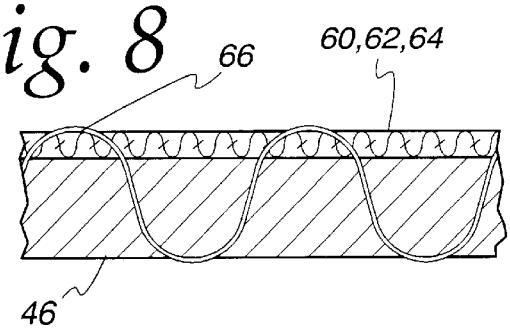
FIG. 8 is a view as in FIGS. 6 and 7 and showing a sheet layer being attached to a support layer by stitching.

The sheets 60, 62, 64 can be mounted directly to the support layer 46 or directly to the support layer 46 and crown 44 by a number of different means. As shown in FIG. 8, the sheets 60, 62, 64 can be secured to the support layer 46 by stitching 66.

Figure 9:
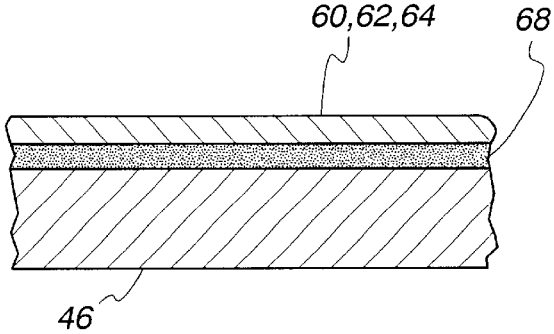
FIG. 9 is a view as in FIG. 8 with the sheet layer applied to the support layer using an adhesive.

As shown in FIG. 9, the sheets 60, 62, 64 can be secured to the support layer 46 through the use of an adhesive layer 68.

As seen in FIG. 4, the sheet 64 is shown to have an additional flap 70 formed integrally therewith. The flap 70 permits attachment directly to the flap 53 on the support layer 46 and/or the lower portion 54 of the crown 44, as by the use of adhesive and/or stitching.

Figure 6:
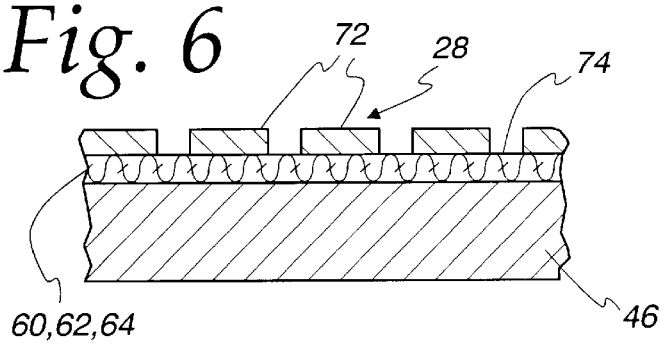
FIG. 6 is a fragmentary, cross-sectional view of the visor taken along line 6—6 on the headwear piece of FIG. 1 and showing one form of sheet layer having information thereon applied by a paint/dye.

The information 22, 28 can be applied in all embodiments by any means known to those skilled in this art. As shown in FIG. 6, the information 28 is applied to the sheets 60, 62, 64 through the use of a dye/paint 72 applied directly to the exposed sheet surface 74.

Figure 7:
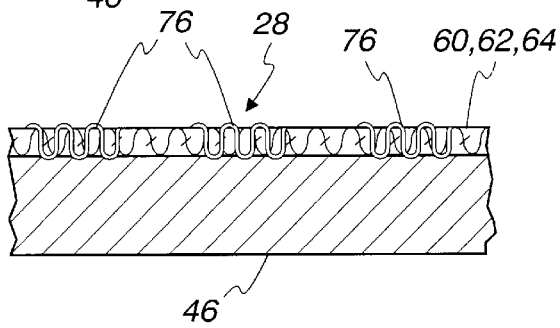
FIG. 7 is a view as in FIG. 6 with a sheet layer having information embroidered thereon and being joined to a support layer.

In FIG. 7, the information 28 is applied in the form of embroidery 76. In this form, the sheets 60, 62, 64 have the information 28 pre-applied before the sheets 60, 62, 64 are mounted to the support layer 46. The information 28 can be applied after the sheets 60, 62, 64 are united with the support layer 46, as shown in FIG. 8. However, this latter method introduces the problem of stitching through the support layer 46, which may have a substantial thickness.

One manner of applying the information 28 is to have the information conform to the contour of the peripheral edge 78 of the visor support layer 46 and the sheets 60, 62, 64 applied thereto. This potentially allows for a unique visual effect to be produced, as seen in FIGS. 2 and 3. The visor 24 is typically formed with an inverted U shape with an upwardly facing surface portion 79 and laterally oppositely facing surface portions 80, 82. The laterally oppositely facing surface portions 80, 82 are visible with the headwear piece being worn, as is seen clearly in FIG. 3. Accordingly, at certain angles, the information 22 on the crown and information 28 on the surface portions 80, 82 of the visor 24 can be viewed simultaneously.

Figure 10:
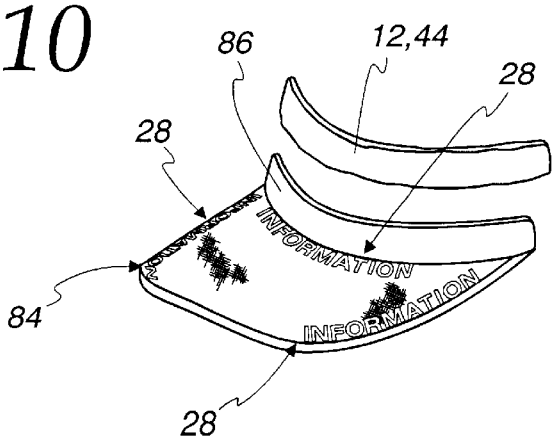
FIG. 10 is an exploded, fragmentary, perspective view showing cooperating structure for connecting a visor to a crown, according to the present invention.

Another aspect of the invention is shown in FIG. 10 wherein a visor 84 is formed without the need for a separate support layer 46, as previously described. The visor 84 may be formed from fabric, plastic, or any other material, and has the aforementioned information 28 applied thereto. The visor 84 has an integral flap 86 which is joinable to the crown 12, 44 as by stitching or adhesive.

In FIGS. 11–15, further modified forms of the invention are shown, each having information thereon relating to golf. The manner of constructing the headwear piece 10 and applying the information, in FIGS. 11–15, are the same as those described with respect to FIGS. 1–10. FIGS. 11–15 differ primarily in the nature of the information.

Figure 11:
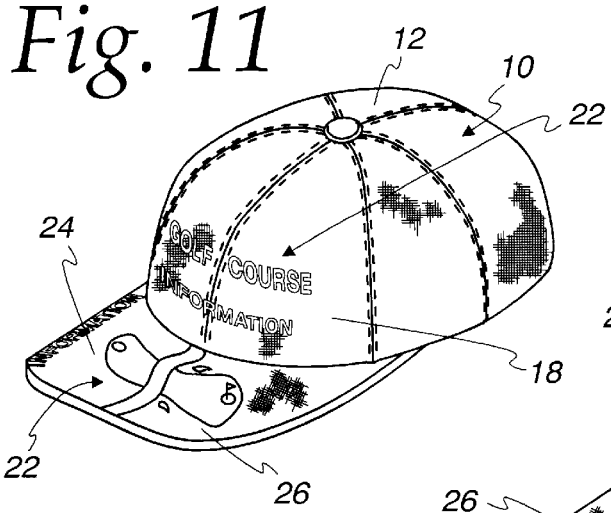
FIG. 11 is a perspective view of a modified form of headwear piece, according to the present invention, having information thereon relating to golf.

In FIG. 11, the headwear piece 10 is shown with information 22 on the visor surface 26 that is a depiction of a hole on a golf course. The hole may be what is commonly referred to as the "signature hole" for the golf course or any other hole. The crown external surface 18 has information 22 thereon related to the same golf course. The information 22 on the crown surface 18 may take a variety of different forms. For example, this information 22 may be the identity of the golf course, a logo used by the golf course, written information relating to the golf course, as previously described, a representation of an animate or inanimate object, the identity of a golf tournament, the identity of an individual in words or picture, a date, a location, an address, an electronic mail address, etc. The individual identified by either name or likeness may be an individual that has won a tournament at the golf course, someone affiliated with the golf course, or a well recognized figure in the golf world. Additional information 22 related to the golf course may be provided in a form in addition to that described above.

Figure 12:
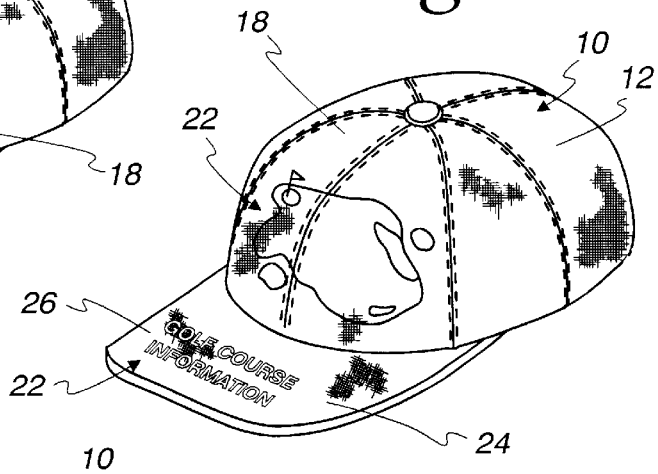
FIG. 12 is a view as in FIG. 11 showing another manner of applying golf information, according to the present invention.

In FIG. 12, a headwear piece 10 is shown with essentially a reversal of the location of the information from that in FIG. 11. That is, the information 22 depicting the hole on the golf course is applied to the crown surface 18, whereas the additional related information 22 that is on the crown surface 18 in FIG. 11 is applied to the visor surface 26 in FIG. 12.

It should also be understood that the information 22 on either of the surfaces 18, 26 could be the depiction of another part of the golf course, such as the clubhouse, some historical edifice, a natural spectacle, or some other manmade object associated with the course.

Figure 13:
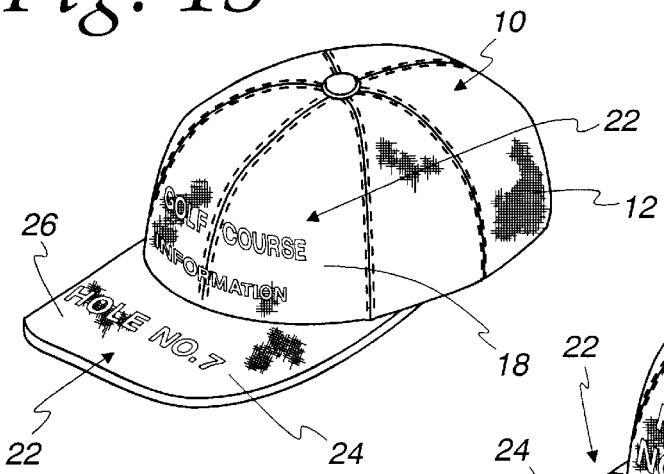
FIG. 13 is a view as in FIGS. 11 and 12 showing another manner of applying golf information, according to the present invention.
Figure 14:
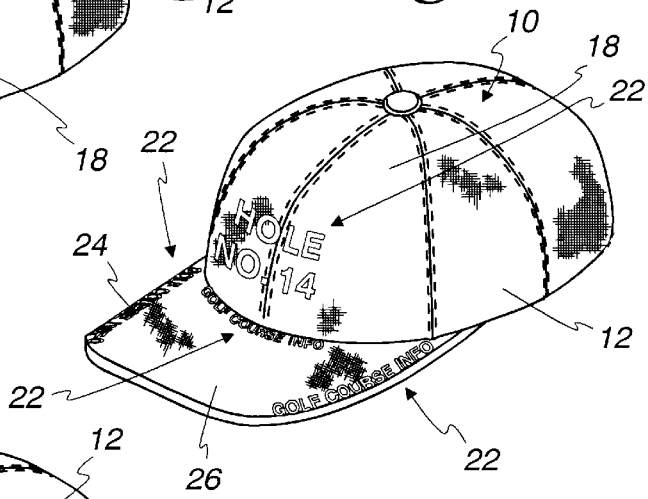
FIG. 14 is a view as in FIGS. 11–13, showing another manner of applying golf information, according to the present invention.

In FIGS. 13 and 14, information relating to a hole on the golf course is shown respectively on the visor surface 26 and crown surface 18. Information related to the golf course is separately applied to the crown surface 18 and visor surface 26 in FIGS. 13 and 14, respectively.

Figure 15:
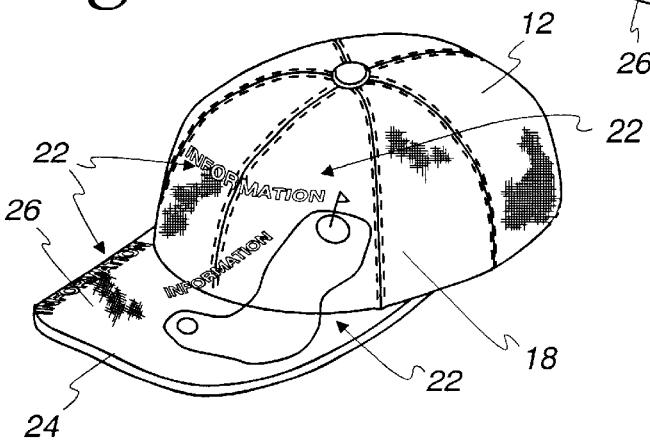
FIG. 15 is a view as in FIGS. 11–14, showing still another manner of applying golf information, according to the present invention.

In FIG. 15, information 22, in the form of a depiction of a hole on the golf course, is shown partially on the visor surface 26 and continuing to the crown surface 18. Other information 22 relating to the golf course is shown separately on the crown surface 18, separately on the visor surface 26, and extending continuously from the visor surface 26 to the crown surface 18.

It should be understood that the precise location of the information 22, 28 is not limited to that shown, nor is the size, style of writing, or arrangement limited to that shown in the drawings herein.

The foregoing disclosure of specific embodiments is intended to be illustrative of the broad concepts comprehended by the invention.

What is claimed is:

1. In combination:

a crown having an internal surface for engaging a wearer's head, and an external surface with information thereon relating to a golf course;

a first visor surface having information thereon relating to the golf course; and a second visor surface having information thereon relating to the golf course that is different than the information on the first visor surface, the first and second visor surfaces being selectively interchangeably and non-removably mountable to the crown so as to project angularly away from the external surface of the crown.

2. The combination according to claim 1 wherein the crown has an inverted cup shape for receiving the head of a wearer.

3. The combination according to claim 1 wherein the information relating to the golf course comprises at least one color relating to the golf course.

4. The combination according to claim 1 wherein the information relating to the golf course comprises at least one of a) a logo, b) written information, c) a representation of at least one of an animate and an inanimate object, d) a depiction of a part of the golf course, and e) a depiction of a hole on the golf course.

5. The combination according to claim 1 wherein the information on at least one of the first and second visor surfaces comprises the name of a golf tournament.

6. The combination according to claim 1 wherein the information on at least one of the first and second visor surfaces comprises at least one of a) a location, b) an address, and c) an electronic mail address.

7. The combination according to claim 1 wherein the first visor surface is applied to a support layer that is attached to the crown and projects angularly away from the external surface of the crown.

8. The combination according to claim 7 wherein the first visor surface is attached to each of the support layer and the crown.

9. The combination according to claim 7 wherein the first visor surface is attached to the support layer using an adhesive.

10. The combination according to claim 7 wherein the first visor surface is attached to the support layer by stitching.

11. The combination according to claim 1 wherein the crown has a front and rear and laterally spaced sides, with the first visor surface mounted to the crown, the first visor surface has an inverted U shape with an upwardly facing surface portion and laterally oppositely facing surface portions, and the information on the first visor surface is located at least partially on one of the laterally oppositely facing surface portions.

12. The combination according to claim 11 wherein with the first visor surface mounted to the crown the first visor surface is part of a visor having a peripheral edge having a contour and the information on the first visor surface follows the contour of the peripheral edge of the visor.

13. The combination according to claim 1 wherein the first and second visor surfaces each comprises at least one sheet layer.

14. The combination according to claim 7 wherein the first visor surface comprises a sheet and the information on the first visor surface is applied to the sheet before the first visor surface is applied to the support layer.

15. The combination according to claim 14 wherein the information on the first visor surface is applied by at least one of a dye/paint and embroidery.

16. The headwear piece according to claim 1 further comprising information on the crown external surface relating to the golf course, wherein the information on at least one of the crown external surface, first visor surface, and second visor surface comprises a depiction of a part of the golf course.

17. The headwear piece according to claim 16 wherein the part of the golf course comprises a hole on the golf course.

18. A headwear piece comprising:

a crown having an internal surface for engaging a wearer's head and an external surface with information non-removably applied thereon relating to a golf course; and a visor projecting angularly away from the external surface of the crown, wherein the visor comprises a surface having information non-removably applied thereon relating to the golf course that is different than the information on the external surface of the crown, wherein the information on one of the crown external surface and visor surface comprises a depiction of a part of the golf course.

19. The headwear piece according to claim 18 wherein the part of the golf course comprises a hole on the golf course.

20. The headwear piece according to claim 18 wherein the information on the other of the crown external surface and visor surface comprises at least one of a) the name of the golf course, b) the identify of a golf tournament, c) the identity of an individual, d) a date, e) a location, f) an address, and g) an electronic mail address.

* * * * *